United States Patent [19]

Loftis

[11] 4,296,820

[45] Oct. 27, 1981

Best Available Copy

[54] DRILLING APPARATUS

[76] Inventor: James B. Loftis, P.O. Box 38, Remlap, Ala. 35217

[21] Appl. No.: 117,562

[22] Filed: Feb. 1, 1980

[51] Int. Cl.[3] ..... E21C 11/02

[52] U.S. Cl. ..... 175/52; 173/164; 173/140; 175/85; 211/60 S

[58] Field of Search ..... 175/52, 85; 173/164, 173/140; 211/60 S; 414/22

[56] References Cited

U.S. PATENT DOCUMENTS

| | | | |
|---|---|---|---|
| 2,781,185 | 2/1957 | Robbins | 211/60 S X |
| 2,972,388 | 2/1961 | Thornburg | 414/22 X |
| 3,157,286 | 11/1964 | Gyongyosi | 211/60 S X |
| 3,552,504 | 1/1971 | Chappuis | 175/52 |

*Primary Examiner*—Ernest R. Purser

*Attorney, Agent, or Firm*—Woodford R. Thompson, Jr.

[57] ABSTRACT

Drilling apparatus embodying an elongated frame supports a transmission unit for longitudinal movement therein. The transmission unit carries a drive head slidably driven by a polygonal, parallel drive shaft and is threadedly connected to one end of a drill rod section in axial alignment therewith. The other end of the drill rod section is connected selectively to another drill rod section and a drill bit. A drill rod rack is mounted for rotation about an axis within the elongated frame and carries a plurality of angularly spaced drill rod sections which are moved sequentially into axial alignment with the driven head whereby it is positioned to drill a hole while extending through the rack. The drill rod sections extend through angularly spaced passageways in a support member which is carried by a shaft at the axis of rotation of the drill rod rack. A movable catch is carried adjacent each passageway and is movable from an outer position to an inner position in engagement with a locking recess in a drill rod section. Each catch is urged toward the inner position and is releasably held in the outer position until a drill rod is inserted. A joint breaker unit is mounted in axial alignment with the driven head at the end of the elongated frame adjacent the hole being drilled and includes an annular member which is mounted for rotation in a transverse frame and detachably connected to a drill rod section extending therethrough.

19 Claims, 19 Drawing Figures

FIG_9
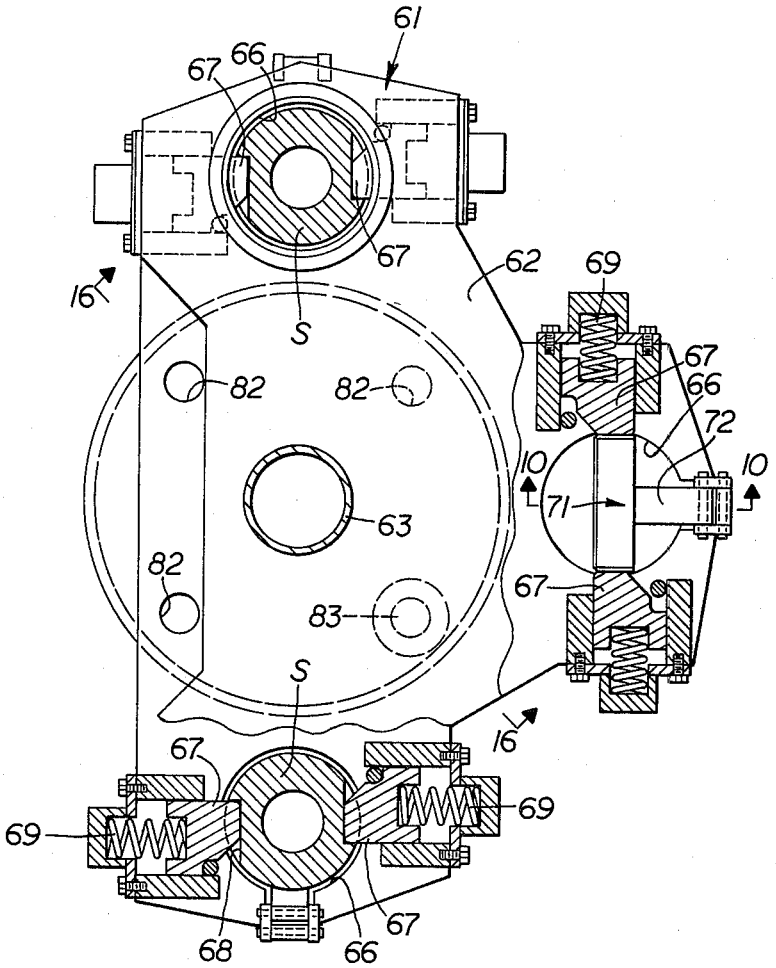
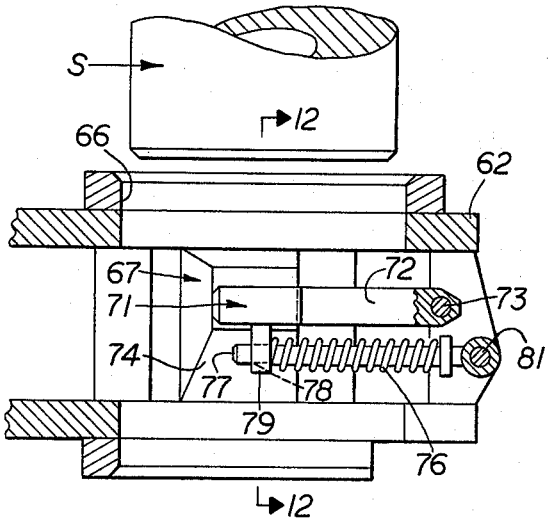
FIG_10
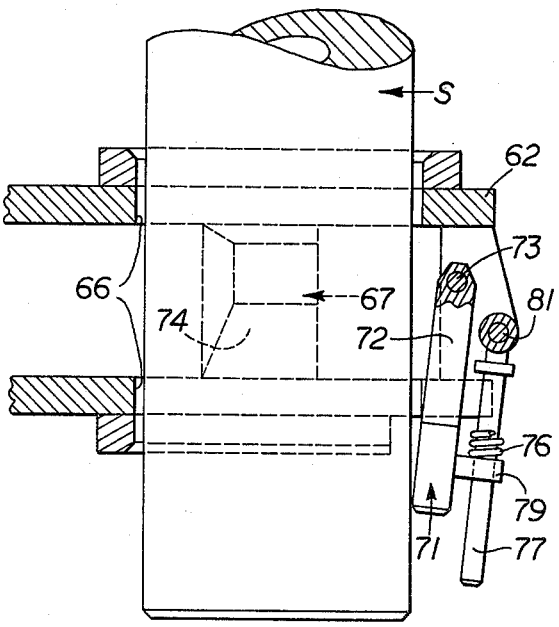
FIG_11

DRILLING APPARATUS

BACKGROUND OF THE INVENTION

This invention relates to drilling apparatus of the type which embodies an elongated frame which supports a transmission unit for longitudinal movement thereof with the transmission unit operatively connecting a polygonal drive shaft to a driven head which is threadedly connected to a drill rod section for drilling a hole into the earth.

Heretofore in the art to which my invention relates, it has been the usual practice to position the drill rod sections sequentially in axial alignment with the driven head of the apparatus by employing a rotatable drill rod rack which was supported outwardly of the frame carrying the drilling apparatus. Such prior art drill rod racks have been supported by arms which swing the entire drill rod rack from the outer inoperative position to an inner operative position. Accordingly, such drill rod racks not only require rotation of the drill rod rack to position selected ones of the drill rod sections in position to move beneath the driven head but also the entire drill rod rack must be swung from the position outwardly of the drill rod frame to a position to align a drill rod section with the driven head. This requires a considerable amount of time and effort due to the fact that the drilling operation must be stopped as the entire drill rod rack is swung from the outer inoperative position to the inner position in addition to the time required to rotate the drill rod rack to position the next drill rod section in proper position to move into axial alignment with the driven head.

Difficulties have also been encountered in providing quick-acting breaker units for breaking the joint between the drill rod section and another drill rod section or a drill bit. That is, such breaker units are complicated in structure and require manual actuation of the various components of the breaker units. This not only requires a considerable amount of time and effort on the part of the worker but also requires that the worker be present at the location of the joint being broken or made, thus exposing the worker to the elements and also to the danger encountered in handling drill rod sections as the joints are made or broken.

CROSS REFERENCE TO RELATED PATENT APPLICATION

My improved apparatus is particularly adapted for use with the drilling apparatus disclosed and claimed in my co-pending U.S. patent application Ser. No. 958,985, filed Nov. 9, 1978, and entitled "DRILLING APPARATUS".

SUMMARY OF THE INVENTION

In accordance with my present invention, I overcome the above and other difficulties by providing drilling apparatus which embodies a drill rod rack which is mounted for rotation about an axis within the confines of the main, elongated supporting frame for the drilling apparatus. The drill rod rack carries a plurality of angularly spaced drill rod sections which are moved sequentially into axial alignment with the driven head. Accordingly, as the drill rod rack is rotated to position the next drill rod section for insertion into the drilling apparatus, it is not necessary to pivot the entire drill rod rack from an outer position to an inner position to position such next drill rod section in axial alignment with the driven head. Also, it is not necessary to remove the drill rod rack from the drill rod section thus inserted into the drilling position. That is to say, each drill rod section is positioned to drill a hole while extending through the drill rod rack without having to swing the entire drill rod rack from an outer inoperative position to an inner operative position and then back out to the inoperative position before the drilling operation can proceed.

In accordance with my invention, I also provide improved means for breaking the joint between the drill rod sections or between a drill rod section and a bit. My improved breaker unit is mounted in axial alignment with the driven head and includes an annular member which is releasably connected to a transverse frame and to a drill rod section extending therethrough.

DESCRIPTION OF THE DRAWINGS

Drilling apparatus embodying features of my invention is illustrated in the accompanying drawings, forming a part of this application, in which:

FIG. 9 is a horizontal, sectional view taken generally along the line 9—9 of FIG. 5 and drawn to a larger scale;

FIG. 10 is an enlarged, fragmental view taken generally along the line 10—10 of FIG. 9 showing the lower end of the drill rod section in the position that it assumes just prior to passage through the opening in the rack;

FIG. 11 is a fragmental, sectional view corresponding to FIG. 10 showing the drill rod section inserted through the opening in the rack;

DETAILED DESCRIPTION

Figure 1:
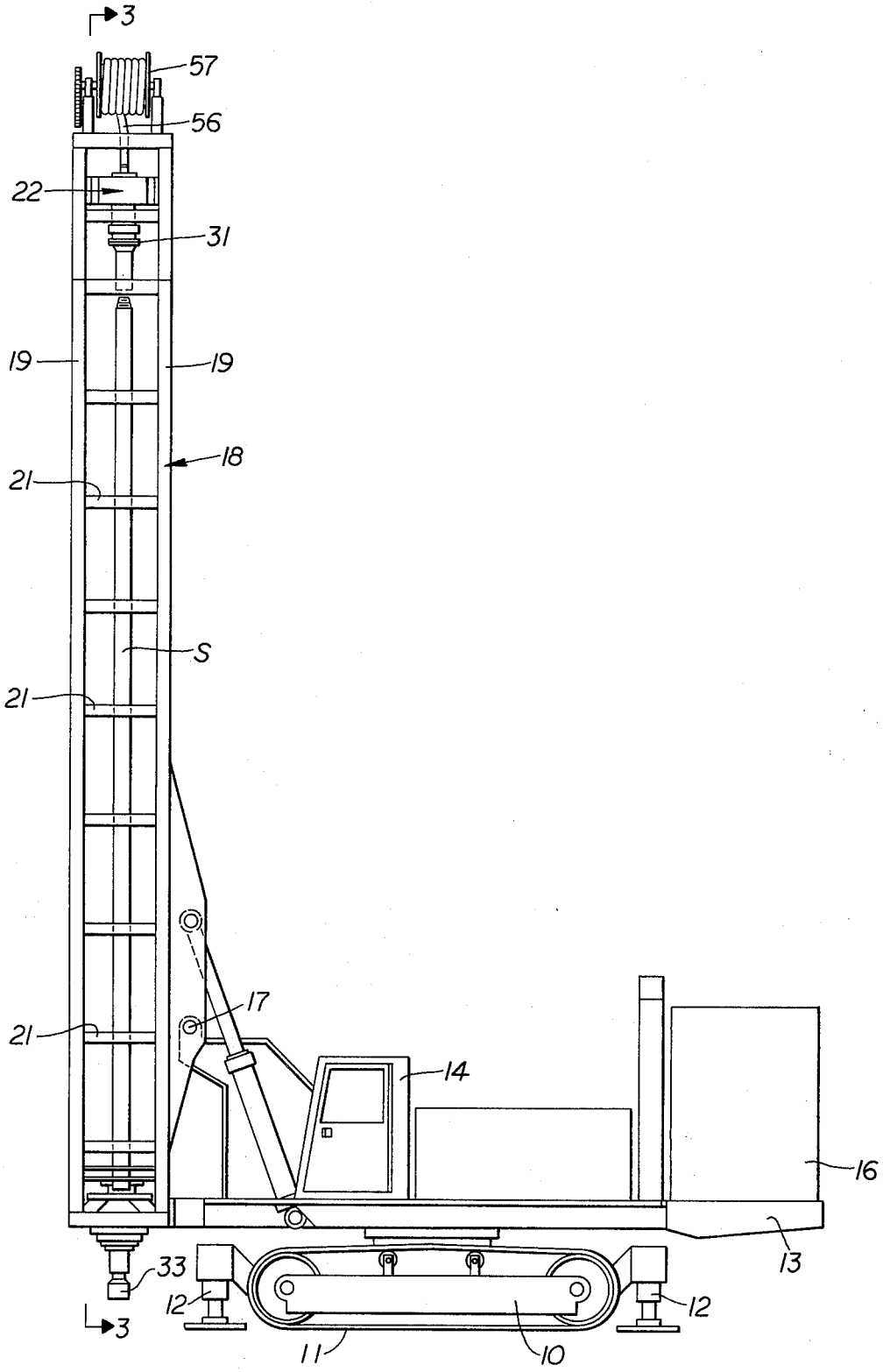
FIG. 1 is a side elevational view showing the drilling apparatus in position to drill a hole vertically into the earth, the drill rod rack and the drill rod sections carried thereby being omitted for the sake of clarity.
Figure 2:
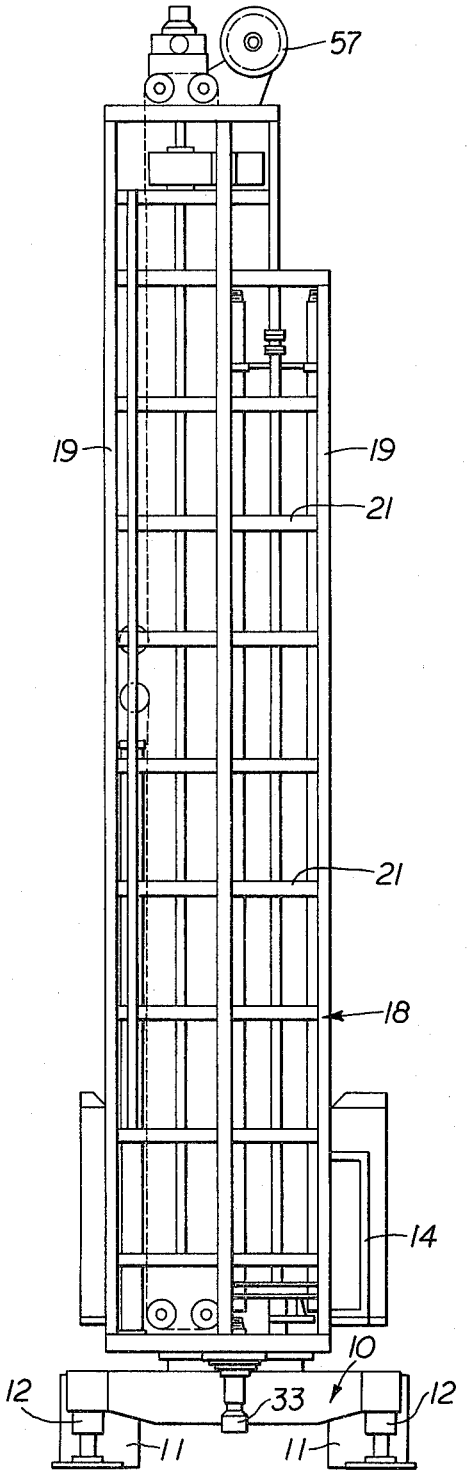
FIG. 2 is a front elevational view looking from the left side of FIG. 1.
Figure 3:
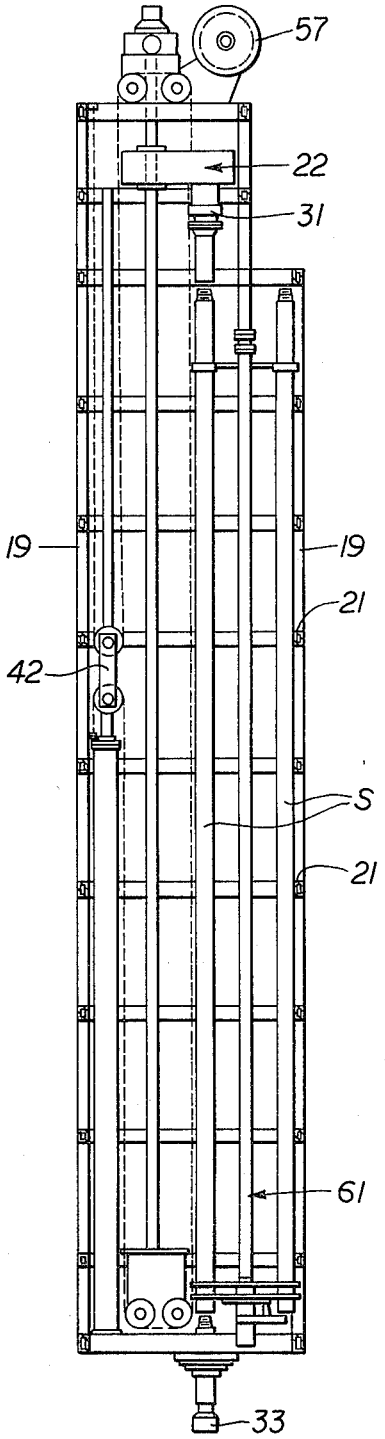
FIG. 3 is a vertical, sectional view taken generally along the line 3—3 of FIG. 1 and showing the drill rod rack and the drill rod sections carried thereby.

Referring now to the drawings for a better understanding of my invention, I show a translatable frame 10 which may be in the form of a heavy-duty tractor-type vehicle having endless tracks 11. Adjustable jack units 12 support the translatable frame at selected fixed positions so that the translatable frame may be adjusted to a level position.

A supporting frame 13 is carried by the translatable frame 10 and is adapted for rotation in a horizontal plane about a vertical axis whereby the supporting frame may be moved to selected angular positions relative to the translatable frame. A suitable cab 14 is mounted on the supporting frame 13, as shown in FIG. 1. The controls, such as valves, switches and the like are all mounted within the cab 14 in a conventional manner whereby the apparatus may be manipulated from the cab 14. A compressor unit 16 is also carried by the supporting frame 13 for supplying compressed air downwardly through the hollow drill rod sections, indicated generally at S whereby cuttings are picked up by the air and conveyed upwardly between the drill rod sections S and the hole being bored and are then discharged adjacent the surface of the ground in a manner well understood in the art to which my invention relates. The cuttings may be removed from the hole being bored in a manner similar to that disclosed in the Robbins U.S. Pat. No. 2,781,185. Since such apparatus is conventional and well known in the art to which my invention relates, no further description thereof is deemed necessary.

Figure 7:
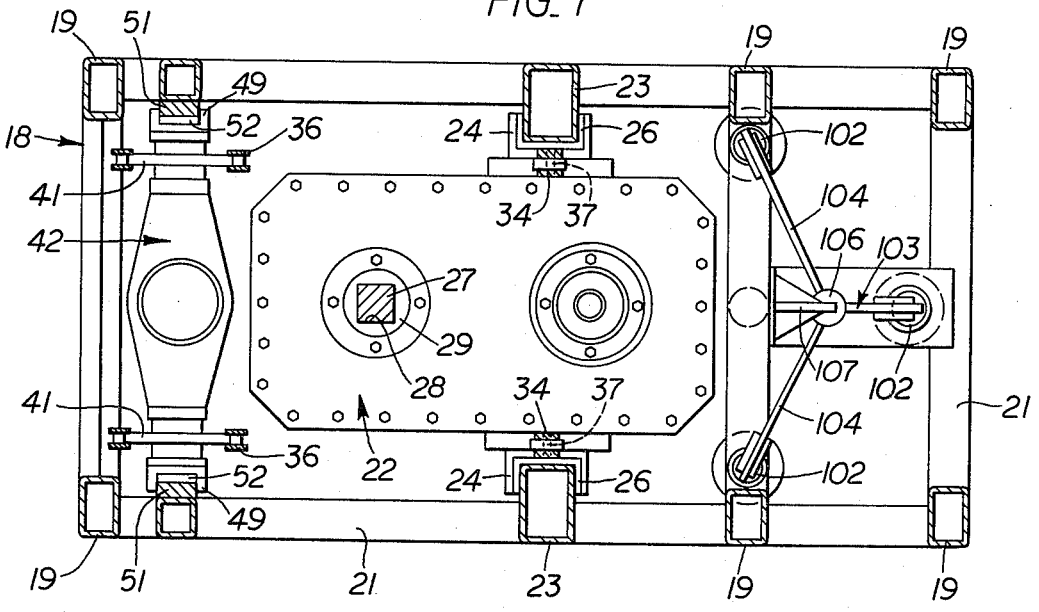
FIG. 7 is a horizontal, sectional view taken generally along the line 7—7 of FIG. 4.
Figure 8:
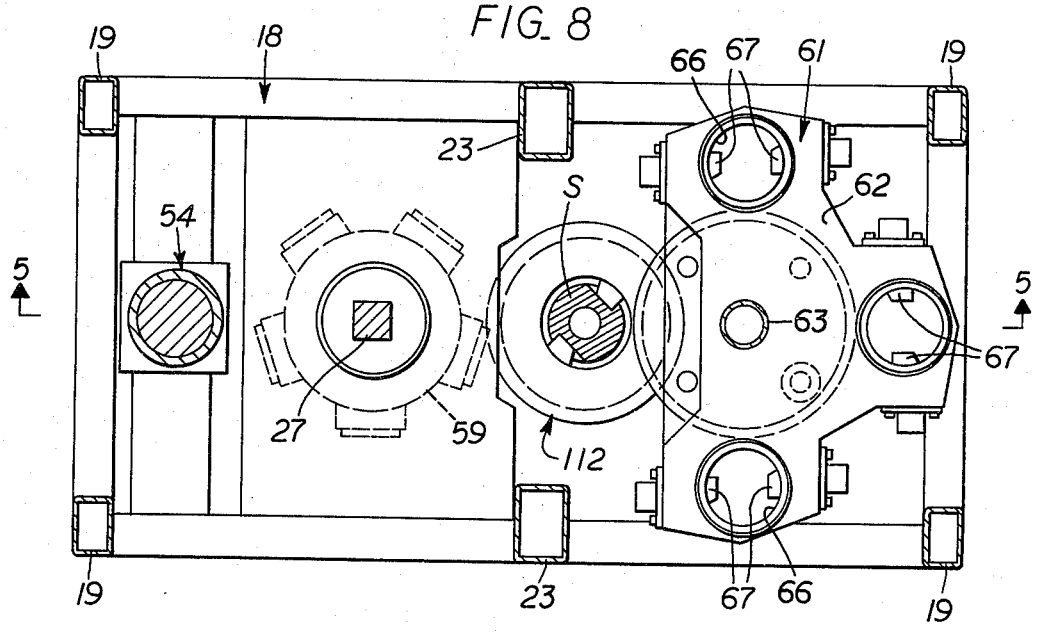
FIG. 8 is a horizontal, sectional view taken generally along the line 8—8 of FIG. 5.

Mounted for pivotal movement about horizontal pivot pins 17 adjacent the forward end of the supporting frame 13 is an elongated boxed-in frame 18 which is generally rectangular, as shown in FIGS. 7 and 8. The elongated frame 18 comprises a plurality of vertically extending frame members 19 which are secured rigidly to each other by a plurality of horizontal frame members 21 to provide rigid structural connections at all four sides of the boxed-in frame 18.

Figure 4:
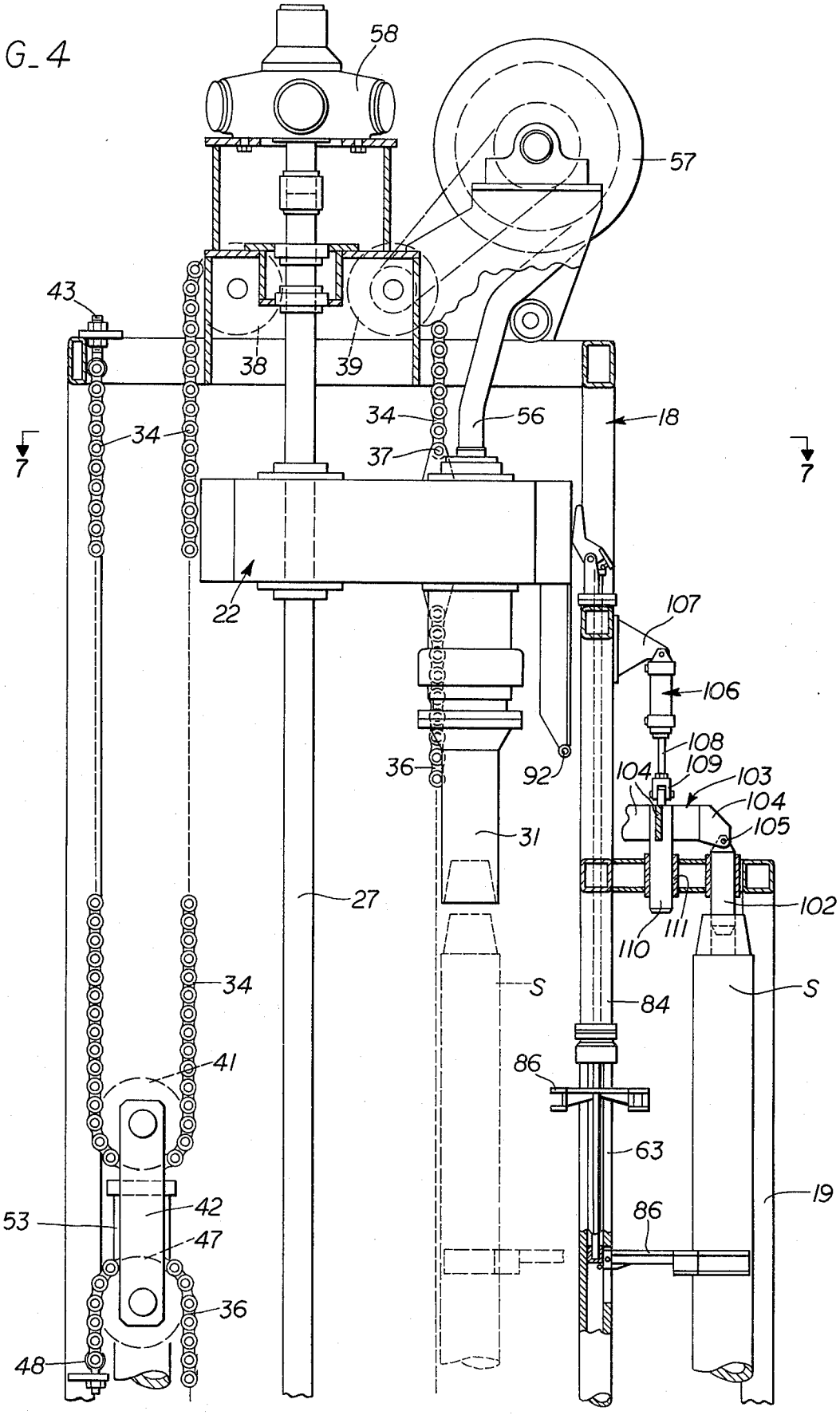
FIG. 4 is an enlarged, vertical sectional view through the upper portion of the apparatus shown in FIG. 3.

Mounted for longitudinal movement within the elongated frame 18 is a transmission unit 22. Vertically extending guide members 23 are carried by the elongated frame 18 at opposite sides of the transmission unit 22 in position to be engaged by generally U-shaped guide members 24 carried by the transmission unit 22, as shown in FIG. 7. To reduce friction between the guide members 24 and the vertical guide members 23, generally U-shaped members 26 formed of a low friction material are inserted between the members 23 and 24, as shown. The low friction material 26 may be in the form of tetrafluoroethylene, sold under the trade name "TEFLON". The transmission unit 22 is driven by a polygonal drive shaft 27 which extends through and slidably engages an opening 28 provided in a rotary drive member 29 of the transmission unit 22 so that the transmission unit 22 is adapted for axial movement along the polygonal shaft 27 as the polygonal shaft 27 drives the rotary member 29. The rotary member 29 is operatively connected to a driven head 31 whereby the driven head rotates one revolution each time the rotary member 29 rotates one revolution. The driven head 31 is adapted to be threadedly connected to one end of an adjacent drill rod section S extending in axial alignment therewith, as shown in FIG. 4. The other end of the drill rod section S is threadedly connected selectively to another drill rod section S and to a drill bit 33 for drilling a hole into the earth. The drill bit 33 may be of a conventional type, such as that shown in the Robbins U.S. Pat. No. 2,781,185.

The transmission unit 22 is moved longitudinally of the elongated frame 18 by up-pulled chains 34 down-pulled chains 36 which are connected by suitable pins 37 to opposite sides of the transmission unit, as shown in FIG. 7. Each up-pulled chain 34 passes over upper sprockets 38 and 39 and then downwardly where it passes under a sprocket 41 of a chain traveler assembly indicated generally at 42. After passing under the sprocket 41, each up-pulled chain 34 extends upwardly toward the upper end of the elongated frame 18 where it is attached thereto by a suitable retainer member 43. Each down-pulled chain 36 extends downwardly and passes beneath lower sprockets 44 and 46 whereupon it then extends upwardly and passes over a sprocket 47 which is also carried by the chain traveler assembly 42. After passing over the sprocket 47, each down-pulled chain 36 extends downwardly and is secured to the elongated frame 18 by a suitable retainer member 48. The chain traveler assembly 42 extends transversely of the elongated frame 18, as shown in FIG. 7. Opposite ends of the chain traveler assembly 42 carry channel-like guides 49 which slidably engage vertically extending guides 51 carried by the elongated frame 18. The guides 49 carry anti-friction members 52 which engage the channel guides 49, as shown. The anti-friction members 52 may be formed of a suitable material, such as tetrafluoroethylene. As shown in FIG. 4, the upper pull chain 34 and the sprockets 38, 39 and 41 associated therewith are provided at each side of the elongated frame 18 and are actuated by the chain traveler assembly 42. In like manner, a lower pull chain 36 and its associated sprockets 44, 46, and 47 are provided at opposite sides of the elongated frame 18 and are also actuated by the chain traveler 42.

Figure 5:
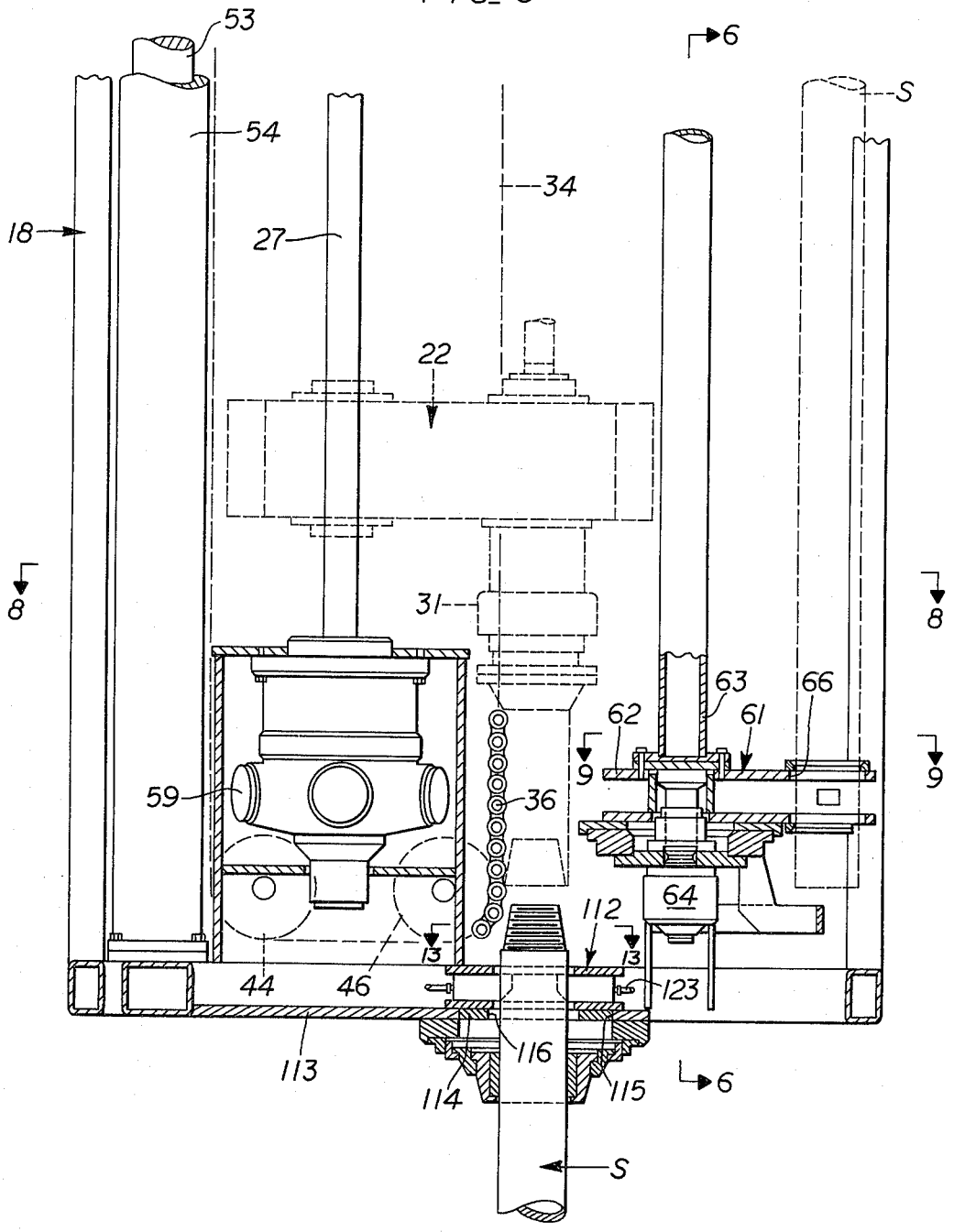
FIG. 5 is an enlarged, vertical sectional view showing the lower portion of the apparatus shown in FIG. 3 and taken generally along the line 5—5 of FIG. 8.
Figure 6:
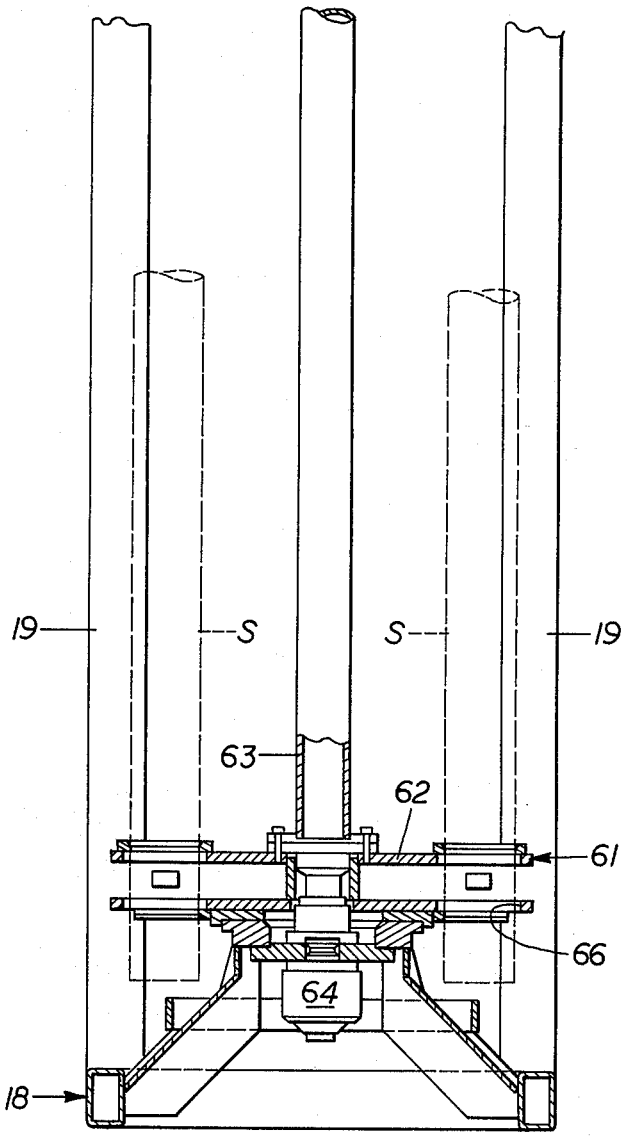
FIG. 6 is a sectional view taken generally along the line 6—6 of FIG. 5.

The chain traveler assembly 42 is connected to the upper end of a piston rod 53 carried by a fluid pressure operated cylinder 54 which is carried by the elongated frame, as shown in FIGS. 4 and 5. Accordingly, each time the piston rod 53 is retracted by the fluid pressure operated cylinder 54, the sprockets 41 are moved downwardly to thus move the chains 34 in a direction to exert an upward pull on the transmission unit 22. On the other hand, upon extending the piston rod 53, the sprockets 47 are moved upward to thus pull the chain 36 in a direction to exert a downward pull on the transmission unit 22.

Air under pressure is supplied to the drill rod sections S through the driven head 31 by a flexible conduit 56 which is carried by a conventional reel unit indicated generally at 57. The reel unit 57 is operatively connected to the sprocket 39 whereby the conduit 56 is extended and retracted in response to raising and lowering the transmission unit 22 and the driven head 31 carried thereby. Air under pressure is supplied to the conduit 56 by the compressor 16. Since the means for supplying air under pressure to the drill rod sections S is well known in the art to which my invention relates, no further description thereof is deemed necessary.

The polygonal drive shaft 27 is driven by an upper drive unit 58 and a lower drive unit 59. The drive unit 58 and 59 may be of the type shown and described in my co-pending U.S. application Ser. No. 958,985 mentioned above.

The drill rod sections S are carried by a rotatable drill rod rack, indicated generally at 61, whereby the drill rod sections S may be positioned sequentially in axial alignment with the driven head 31. The drill rod rack 61 comprises a horizontal support member 62 carried by the lower portion of a vertical shaft-like member 63 which is mounted for rotation about a vertical axis. Power actuated means, such as a fluid pressure operated motor 64, is operatively connected to the shaft-like member 63 for rotating the drill rod rack to selected angular positions. As shown in FIGS. 5, 6 and 9–12, angularly spaced passageways 66 are provided through the horizontal support member 62 for receiving the drill rod sections S. Movable latch members 67 are carried by the horizontal support member 62 at opposite sides of each passageway 66 and each is adapted to move from an outer position to an inner position in engagement with a locking recess 68 in the drill rod section S extending through the opening 66 to thus support the drill rod section S. Resilient means such as a spring 69, urges each movable catch member 67 inwardly into engagement with its associated locking recess 68, as shown in FIG. 9.

To hold the catch members 67 in their outer, inoperative position until a drill rod section S is inserted through the passageway 66, I provide a transverse member 71 of a length to span the distance between the catch members 67 while the catch members are in their outer, inoperative position. An arm 72 is connected at one end to the transverse member 71 while the other end of the arm 72 is pivotally connected by a pivot pin 73 to the horizontal support member 62 so that the transverse member 71 is moved from a position between the catch members 67 to a position outwardly of the passageway 66 upon movement of a drill rod section S downwardly through the passageway 66. An upwardly and inwardly sloping cam surface 74 is provided on the under surface of each catch member 67 in position to be engaged by the transverse member 71 upon upward movement of the transverse member whereby the catch members 67 are moved by the transverse member to their outer positions. Resilient means, such as a compression spring 76, urges the transverse member 71 upwardly between the catch member 67 upon removal of a drill rod section S from the passageway 66. The compression spring 76 may be retained in place by an elongated rod 77 which extends through an opening 78 provided in a depending bracket 79 carried by the transverse member 71, as shown in FIGS. 10 and 11. The outer end of the rod 77 is pivotally connected by a pivot pin 81 to an adjacent portion of the horizontal support member 62. It will be noted that FIG. 10 shows the transverse member 71 in position to retain the latch members 67 in their outermost position while the drill rod section S is outwardly of the recess 66. FIG. 11, on the other hand, shows the position that the transverse member 71 assumes upon insertion of the drill rod section S down through the opening 66.

It will thus be seen that the drill rod rack 61 is mounted for rotation about an axis within the elongated frame 18 and is adapted to carry a plurality of angularly spaced drill rod sections S with the drill rod sections being movable sequentially into axial alignment with the driven head 31 upon rotation of the drill rod rack to selected angular positions about the axis of the vertical shaft 63. Accordingly, as each drill rod section carried by the drill rod rack is moved into axial alignment with the driven head 31 it is positioned to drill a hole while extending through the drill rod rack 61.

Figure 16:
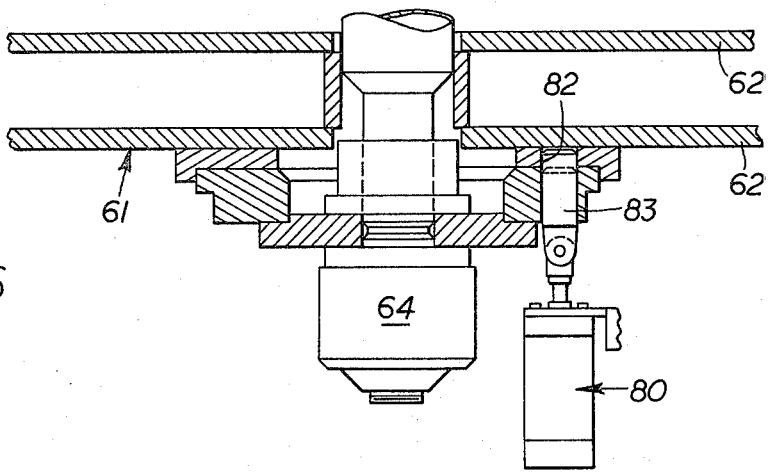
FIG. 16 is a sectional view taken generally along the line 16—16 of FIG. 9.

As shown in FIG. 16, angularly spaced locking elements, such as recesses 82, are provided in the under surface of the horizontal support member 62 in position to engage a stationary cooperating locking element, such as a plunger-like member 83 whereby the drill rod rack 61 is retained in a locked position each time a drill rod section S is positioned sequentially in axial alignment with the driven head 31. The member 83 may be actuated by a fluid pressure operated unit 80.

Figure 19:
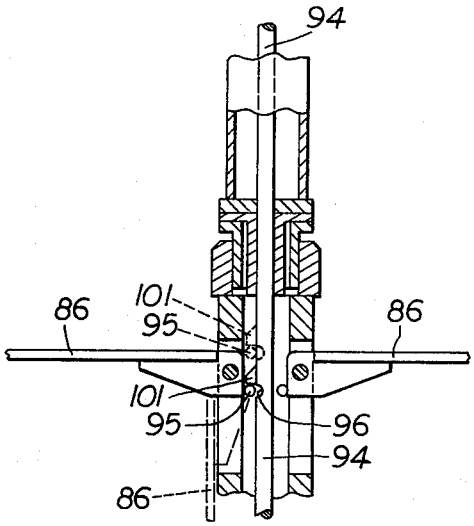
Figure 17:
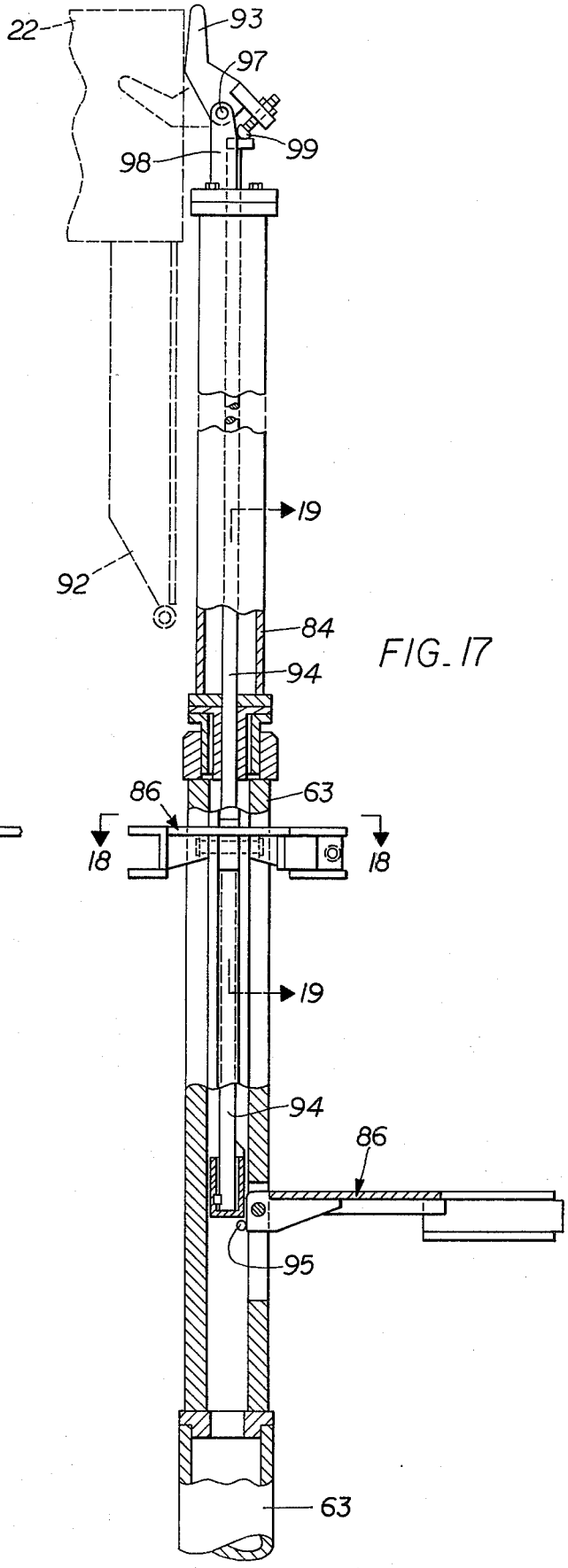
FIG. 17 is an enlarged view, partly broken away and in section, showing the upper portion of the drill rod rack shown in FIG. 4.

As shown in FIG. 17, the upper end of the vertical shaft-like member 63 is rotatably connected to the lower end of a column 84 which is fixedly secured to the elongated frame 18, as shown in FIG. 4. As shown in FIGS. 4, 17, 18 and 19, radially extending arms 86 are carried by the upper portion of the vertical shaft-like member 63 in angularly spaced relation to each other. A drill rod section retainer member 87 is carried by the outer end of each arm 86 in position to receive the upper portion of drill rod section S carried by the drill rack. Each drill rod section retainer member 87 is in the form of a generally U-shaped, outwardly opening recess 88 which receives a drill rod section S. A releasable latch element 89 is mounted adjacent one side of the recess 88 for holding a drill rod section S within the recess 88. Resilient means, such as a spring 91 urges the latch element 89 into engagement with the drill rod section whereby it is releasably held in place. Each radially extending arm 86 is pivotally connected to the vertical shaft-like member 63 and is movable selectively to a generally horizontal position, as shown in FIGS. 17 and 19, and to a depending vertical position alongside the vertical shaft-like member 63, as shown in dotted lines in FIG. 19. Each radially extending arm 86 remains in the horizontal position until its drill rod section is moved into axial alignment with the driven head 31 and the transmission unit 22 is moved downwardly. An actuator member 92 is carried by the transmission unit 22 in position to engage the radially extending arm 86 which holds the drill rod section S that is in axial alignment with the driven head 31. Accordingly, as this radially extending arm 86 is moved downwardly from the solid line position 19 to the dotted line position, it moves out of the path of movement of the transmission unit. Upon upward movement of the transmission unit 22, a movable element 93 is actuated to return the radially extending arm 86 from the dotted line position shown in FIG. 19 to the horizontal, solid line position.

As shown in FIGS. 17 and 19, a rod 94 is mounted for longitudinal, vertical movement within an axially extending passageway through the column 84 and the vertical shaft-like member 63. An inwardly projecting detent 94 is carried by the inner end of each radially extending arm 86 adjacent the rod 94. As shown in FIG. 19, a recess 96 and a detent 101 is carried by the side of the rod 94 facing the inwardly projecting detent 95 carried by an upper arm 86 which retains the drill rod section S which is in axial alignment with the driven head 31. The recess 96 is adapted to receive the detent 95 so that upon downward pivotal movement of the radially extending arm 86 that engages the drill rod section in axial alignment with the driven head, the detent 95 engages the recess 96 and a detent 101 and lifts the rod 94. The movable element 93 is pivotally connected by a pivot pin 97 to a support bracket 98 carried by the vertical column 84 whereby the movable element 93 is movable selectively to the solid line position and the dotted line position shown in FIG. 17. The end of the movable element 93 opposite the end thereof engaged by the transmission unit 22 carries an adjustable element 99 which is adapted to engage the upper end of the rod 94 whereby the rod 94 is moved downwardly upon movement of the movable element 93 from the dotted line position shown in FIG. 17 to the solid line position. That is, as the transmission unit 22 moves upwardly, it engages the movable element 93 and moves the same from the dotted line position to the solid line position to thus move the rod 94 downwardly whereupon a detent 101 carried by the rod 94 engages the inwardly projecting detent 95 carried by the arm 86 to thus return the arm 86 to the horizontal position shown in FIG. 19. As shown in FIG. 17, the detent 95 carried by the lowermost arm 86 engages the lower end of the rod 94 to lift the same upon downward movement of this arm by the actuator member 92. The lowermost arm 86 is returned to its horizontal position upon downward movement of the rod 94 by the movable element 93.

As shown in FIGS. 4 and 7, angularly spaced retainer members 102 are carried by a common support unit, indicated generally at 103, with each retainer member 102 having a cylindrical outer surface adapted to engage the upper end of a drill rod section S and limit lateral movement thereof. Each support unit 103 is shown as comprising radially extending arms 104 which are rigidly connected to each other with a retainer member 102 being pivotally connected to the outer end of each arm 104 by a pivot pin 105. A power actuated unit, such as a fluid pressure operated cylinder 106 is pivotally connected to a support bracket 107 with the piston rod 108 of the cylinder 106 being pivotally connected to the support unit 103 by suitable means, such as a clevis connection 109. Depending from the central portion of the support unit 103 is a plunger-like member 110 which is adapted for axial, sliding movement within a sleeve-like member 111 whereby the support unit 103 moves in a vertical direction as it moves the retainer members 102 selectively to an upper inoperative position and to a lower operative position with the retainer members engaging the drill rod sections S.

Figure 15:
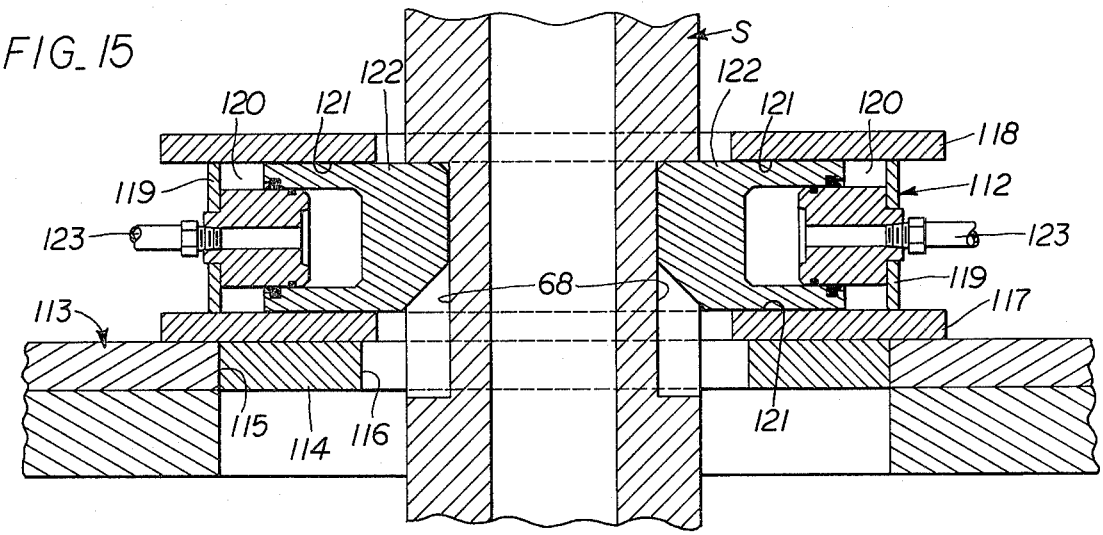
FIG. 15 is a fragmental, sectional view taken generally along the line 15—15 of FIG. 13.
Figure 12:
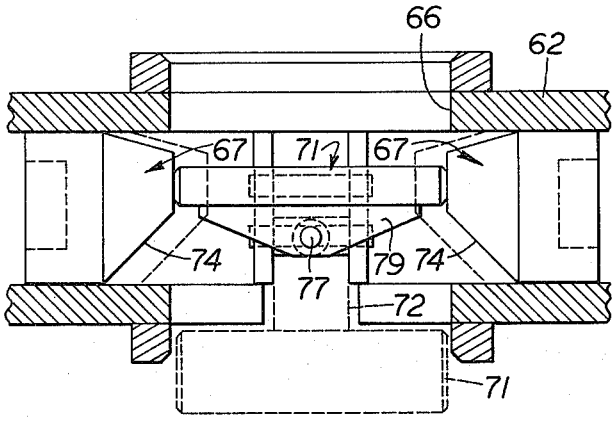
FIG. 12 is a fragmental, sectional view taken generally along the line 12—12 of FIG. 10.

To break the joint between the drill rod section S and another drill rod section S or a drill bit 33, I provide a breaker unit, indicated generally at 112, which is carried by the lower portion of the frame 18 in axial alignment with the driven head 31. The breaker unit 112 is supported by a transverse frame 113 carried by the elongated frame 18. An annular member 114 is mounted for rotation within an opening 115 through the transverse frame 113. An annular, centrally disposed opening 116 is provided through the annular member 114 for passing a drill rod section S therethrough, as shown in FIGS. 5 and 15. The annular member 114 carries an annular member 117 which is secured to an upper annular member 118 by vertical plates 119, as clearly shown in FIG. 15. Other vertical plates 120 are mounted in spaced relation to each other between the annular members 117 and 118 and are connected to the vertical plate 119 to define a cylinder-like chamber 121 at opposite sides of the drill rod section S which extends in axial alignment with the driven head 31. Mounted for sliding movement in each chamber 121 is a piston-like dog 122 which defines a releasable latch element which is adapted to engage a locking recess 68 provided in the drill rod section S which passes through the annular member 114, as shown. A fluid supply conduit 123 communicates with each of the cylinder-like chambers 121 for supplying fluid thereto and exhausting fluid therefrom so that the piston-like dog 122 is moved selectively toward and away from the locking recess 68.

Figure 13:
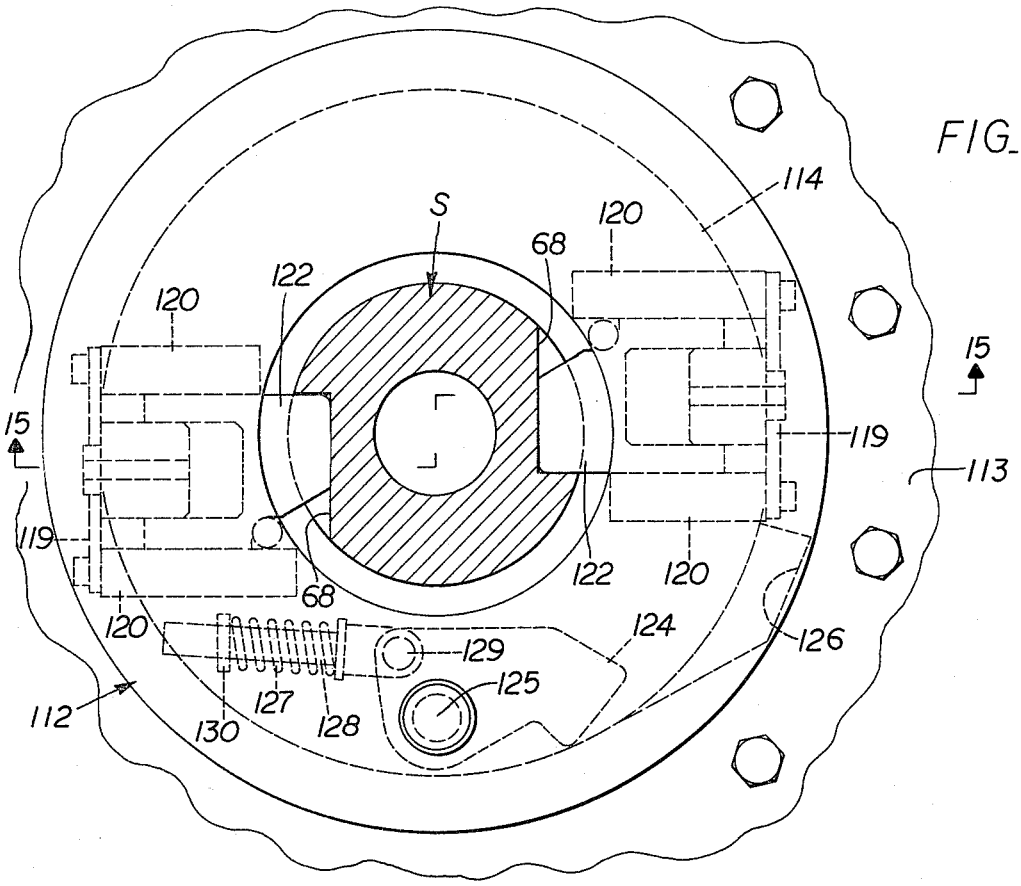
FIG. 13 is an enlarged, fragmental view taken generally along the line 13—13 of FIG. 5.
Figure 14:
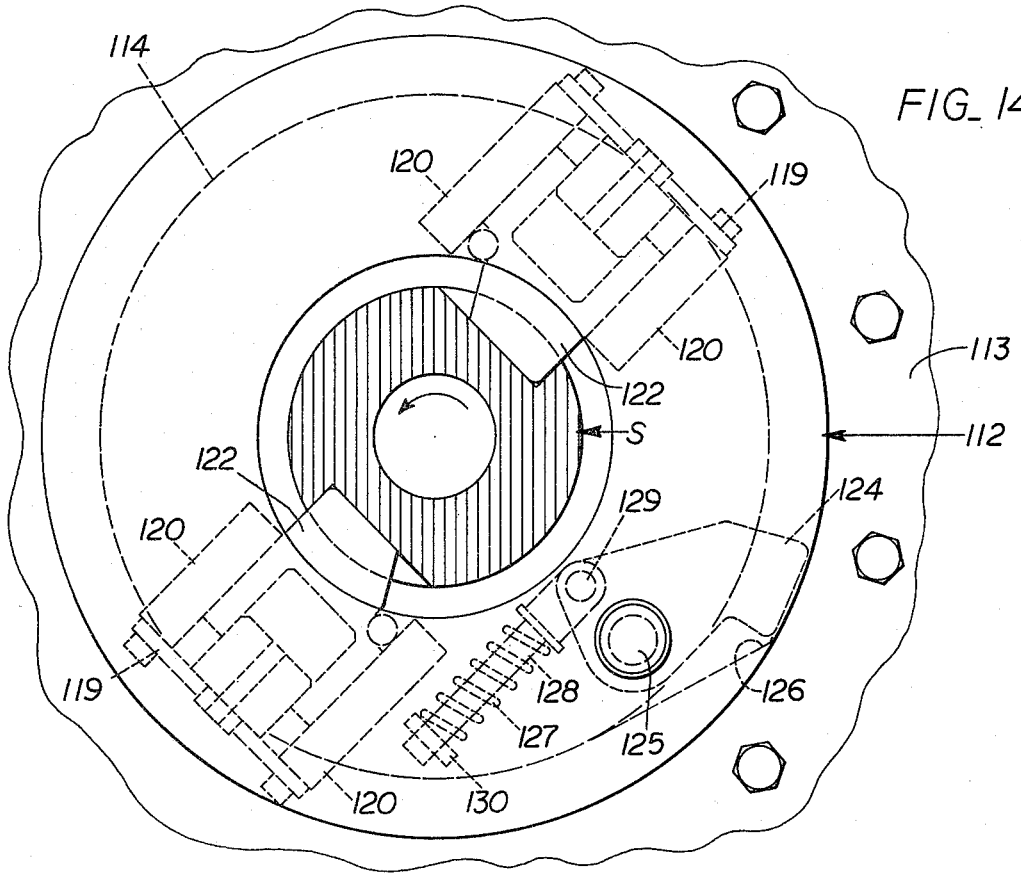
FIG. 14 is a view corresponding to FIG. 13 showing the breaker unit in position to break the joint between drill rod sections.
Figure 18:
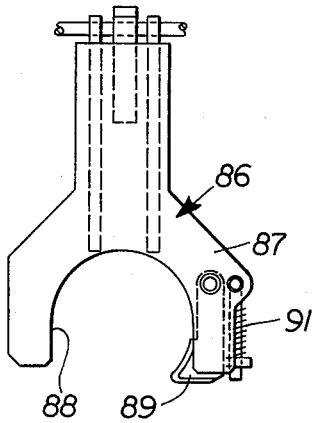
FIG. 18 is a sectional view taken generally along the line 18—18 of FIG. 17; and, FIG. 19 is a fragmental, sectional view taken generally along the line 19—19 of FIG. 17.

To lock the rotatable member 114 to the transverse frame 113, a movable member in the form of a pawl-like catch 124 is pivotally mounted on a pivot pin 125, as shown in FIGS. 13 and 14, whereby the pawl-like catch 124 is adapted to move selectively to a position inwardly of the annular member 114, as shown in FIG. 13 to a position outwardly thereof, as shown in FIG. 14. A recess 126 is provided in the transverse member 113 in position to receive and limit rotation of the pawl-like catch 124 upon rotation of the annular member 114 to position the pawl-like catch 124 opposite the recess 126. A spring member 127 is interposed between the pawl-like catch 124 and the annular member 114 whereby the pawl-like catch 124 is urged toward the outer position, as shown in FIG. 14. The spring member 127 surrounds an elongated rod-like member 128 which is pivotally connected at one end by a pivot pin 129 to the pawl-like catch 124. The other end of the rod-like member 128 slidably engages a recess in a guide bracket 130.

In operation, the translatable frame 10 is moved to a predetermined location and is fixedly supported by the ground engaging jacks 12. Preferably, a drill rod section S is positioned in each of the passageways 66 through the drill rack 61 and another drill rod section S is carried by the driven head 31. As the first drill rod section S moves downwardly during the drilling operation, the joint between the drill rod section S and the driven head 31 is broken by my improved breaker unit 112. This is accomplished by introducing fluid under pressure through the conduits 123 whereby the piston-like dogs 122 move into locking engagement with the locking recesses 68, thus locking the annular member 114 to the drill rod section S which is connected to the driven head 31. Upon rotation of the drill rod head 31 the drill rod section S rotates the rotatable member 114 from the position shown in FIG. 13 to the position shown in FIG. 14 whereupon the pawl-like catch 124 moves from its innermost position to its outer position whereupon it engages the recess 126 to thus restrain rotation of the drill rod section S. The rotation of driven head 31 is then continued in a direction to unscrew the driven head 31 from the drill rod section S. The driven head 31 is then moved to its uppermost position and the next drill rod section S is then moved into axial alignment with the driven head 31 by merely rotating the drill rod rack 61 whereupon the drill rod section is then connected to the drill bit and to the driven head by rotating the driven head 31 in the proper direction. To release the piston-like dogs 122 from the locking recesses 68 in the drill rod section S, fluid is merely exhausted through the conduits 123 whereupon the piston-like dogs 122 move out of engagement with the locking recesses 68. The other drill rod sections S are then moved sequentially beneath the driven head 31 as the drilling operation continues.

To insert the drill rod sections S into the openings 66, the transverse member 71 retains the movable latch members 67 in their outermost position until the lower end of the drill rod section S enters the opening 66. The drill rod section S then moves the transverse member 71 downwardly from the position shown in FIG. 10 to the position shown in FIG. 11 whereby the movable latch members 67 do not interfere with movement of the drill section S into the opening 66. The upper ends of the drill rod sections S carried by the drill rod rack 61 are retained in position by the radially extending arms 86 and the depending retainer elements 102, as described hereinabove.

It will thus be seen that as each drill rod section carried by the drill rod rack 61 is moved into axial alignment with the driven head 31 it is positioned to drill a hole while extending through the drill rod rack 61. That is to say, the drill rod rack 61 is merely rotated to position the drill rod sections sequentially beneath the driven head 31, thus eliminating the necessity of having to swing the entire drill rod rack inwardly and outwardly relative to the driven head 31 each time a drill rod section S is changed.

From the foregoing, it will be seen that I have devised improved drilling apparatus for drilling a hole into the earth. By providing the apparatus wherein the drilling operation takes place while the drill rod section remains in the drill rod rack, I not only greatly reduce the time and effort required to change the drill rod sections, but also the apparatus for supplying the drill rod sections is extremely simple of construction, economical of manufacture and eliminates the necessity of the drill operator being present adjacent the hole being drilled. This is especially true in view of the fact that my improved breaker unit permits the breaking operation to be accomplished by remote control means.

While I have shown the apparatus the as drilling a vertical hole into the earth, it will be apparent the the frame 18 may be moved to other angular positions relative to the supporting pins 17 to drill holes in selected angular positions.

While I have shown my invention in several forms, it will be obvious to those skilled in the art that it is not so limited, but is susceptible of various other changes and modifications without departing from the spirit thereof.

What I claim is:

1. The combination with drilling apparatus having an elongated frame supporting a transmission unit for longitudinal movement therein with the transmission unit operatively connecting a longitudinally extending polygonal drive shaft to a driven head disposed to be threadedly connected to one end of an adjacent drill rod section extending in axial alignment therewith with the other end of the drill rod section being threadedly connected selectively to another drill rod section and a drill bit for drilling a hole into the earth, the improvement comprising:

(a) a drill rod rack mounted for rotation about an axis within said elongated frame and adapted to carry a plurality of angularly spaced drill rod sections with said drill rod sections being movable sequentially into axial alignment with said driven head upon rotation of said drill rod rack to selected angular positions about said axis so that as each drill rod section carried by said drill rod rack is moved into axial alignment with said driven head it is positioned to drill a hole while said drill rod section and said driven head move through said drill rod rack, and (b) a breaker unit carried by the end of said elongated frame adjacent the hole being drilled into the earth and in axial alignment with said driven head for breaking the joint selectively between said driven head and a drill rod section, between drill rod sections and between a drill rod section and a drill bit.

2. The combination as defined in claim 1 in which said breaker unit comprises:

(a) a transverse frame member carried by said elongated frame, (b) an annular member mounted for rotation within an opening through said transverse frame with there being a centrally disposed opening through said annular member for passing a drill rod section therethrough, (c) a movable member carried by said annular member and adapted for movement selectively to a position inwardly of said annular member and to a position outwardly thereof, (d) means urging said movable member toward said position outwardly of said annular member, (e) there being a recess in said transverse frame member disposed to receive and limit rotation of said movable member upon rotation of said annular member to position said movable member opposite said recess, and (f) at least one releasable latch element carried by said annular member and disposed to engage a locking recess in the drill rod section which passes through said annular member to restrain rotation thereof.

3. The combination as defined in claim 2 in which said movable member is a pawl-like catch pivotally mounted on said annular member and spring means is interposed between said pawl-like catch and said annular member to urge said pawl-like catch toward a position outwardly of said annular member.

4. The combination as defined in claim 2 in which said releasable latch element comprises a piston-like dog mounted for movement in a cylinder toward and away from said locking recess and fluid supply means communicates with said cylinder to supply fluid thereto and exhaust fluid therefrom so that said piston-like dog is moved selectively toward and away from said locking recess.

5. The combination as defined in claim 1 in which said drill rod sections carried by said rack are supported by means comprising:

(a) a support member adjacent one end of said rack, (b) angularly spaced passageways through said support member for receiving said drill rod sections, (c) at least one movable catch member carried by said support member adjacent each said passageway therethrough and adapted to move from an outer position to an inner position in engagement with a locking recess in a drill rod section extending therethrough to thus support the drill rod section, and, (d) resilient means urging said movable catch member inwardly into engagement with said locking recess.

6. The combination as defined in claim 5 in which oppositely disposed movable catch members are carried by said support member at opposite sides of said passageway and releasable means holds said catch member in said outer position until a drill rod section is inserted through said passageway.

7. The combination as defined in claim 6 in which said releasable means holding said catch members in said outer position comprises:

(a) a transverse member of a length to span the distance between said catch members while said catch members are in said outer position, (b) an arm connected at one end to said transverse member, (c) means pivotally connecting the other end of said arm to said support member so that said transverse member is moved from a position between said catch members to a position outwardly of said passageway upon movement of a drill rod section through said passageway, (d) a sloping cam surface on said catch members in position to be engaged by said transverse member upon inward movement of said transverse member whereby said catch members are moved by said transverse member to said outer position, and (e) resilient means urging said transverse member inwardly between said catch members upon removal of a drill rod section from said passageway.

8. The combination as defined in claim 5 in which said support member is carried by a vertical shaft-like member mounted for rotation about said axis, and power actuated means is operatively connected to said shaft-like member for rotating said drill rod rack to selected angular positions to position said drill rod sections sequentially in axial alignment with said driven head.

9. The combination as defined in claim 5 in which angularly spaced locking elements are provided in said support member in position to engage a stationary cooperating locking element whereby said drill rod rack is retained in a locked position each time a drill rod section is positioned sequentially in axial alignment with said driven head.

10. The combination as defined in claim 9 in which said locking elements are angularly spaced locking recesses in the under surface of said support member and said stationary cooperating locking element is a plunger-like member carried by a power actuated unit which moves said plunger-like member into a recess each time a drill rod section is moved into axial alignment with said driven head.

11. The combination as defined in claim 8 in which the upper end of said vertical shaft-like member is rotatably connected to the lower end of a column which is fixedly secured to said elongated frame.

12. The combination as defined in claim 8 in which radially extending arms are carried by the upper portion of said vertical shaft-like member in angularly spaced relation to each other and drill rod section retainer members are carried by the outer ends of said arms in position to receive upper portions of the drill rod sections carried by said drill rod rack.

13. The combination as defined in claim 12 in which each said drill rod section retainer member comprises a generally U-shaped outwardly opening recess for receiving a drill rod section and a releasable latch element is mounted adjacent at least one side of said recess for holding a drill rod section within said recess.

14. The combination as defined in claim 12 in which each of said radially extending arms is pivotally connected to said vertical shaft-like member and is movable selectively to a generally horizontal position and a depending vertical position alongside said vertical shaft-like member, and actuator means moves the radially extending arm in axial alignment with said driven head downwardly to said depending vertical position upon downward movement of said transmission unit and returns said radially extending arm in axial alignment with said driven head to said horizontal position upon upward movement of said transmission unit.

15. The combination as defined in claim 14 in which said actuator means comprises:

(a) an actuator element carried by said transmission unit in position to engage said radially extending arm in axial alignment with said driven head and move the same down upon downward movement of said transmission unit, (b) a rod mounted for vertical movement within an axially extending passageway in said vertical shaft-like member, (c) an inwardly projecting detent carried by the inner end of each said radially extending arm and positioned adjacent said rod, (d) a recess and detent carried by said rod facing and receiving the inwardly projecting detent of the radially extending arm that engages the drill rod section in axial alignment with said driven head so that upon downward pivotal movement of the radially extending arm that engages the drill rod section in axial alignment with said driven head said detent on said arm engages said recess and detent carried by said rod and lifts said rod, and (e) a movable element supported adjacent the upper end of said rod and operatively connected to said rod so that upon upward movement of said rod said movable element moves in one direction into the path of movement of said transmission unit and upon movement of said movable element in the opposite direction in response to upward movement of said transmission unit said detent carried by said rod is moved downward and engages the detent carried by said radially extending arm in axial alignment with the driven head to thus move said radially extending arm to its horizontal position.

16. The combination as defined in claim 8 in which angularly spaced retainer members are carried by a common support unit with each retainer member being adapted to engage the upper end of a drill rod section and limit lateral movement thereof and power actuated means is operatively connected to said support unit to move said support unit and the retainer members carried thereby selectively to an upper inoperative position and a lower operative position with said retainer members engaging said drill rod sections.

17. The combination as defined in claim 16 in which each said retainer member is a depending member of a size and shape to enter the upper end of a drill rod section upon movement of said support unit to said lower operative position.

18. The combination as defined in claim 16 in which said support member comprises a plurality of radially extending arms connected at their inner ends to each other with the outer ends of said arms being connected to the upper ends of said retainer members.

19. The combination as defined in claim 18 in which the inner ends of said arms are also connected to a depending guide member which slidably engages a cooperating guide member carried by said drill rod rack.

* * * * *